US005612159A

United States Patent [19]

Sato et al.

[11] Patent Number: 5,612,159

[45] Date of Patent: Mar. 18, 1997

[54] TONER COMPOSITION FOR ELECTROSTATIC CHARGE DEVELOPMENT AND IMAGE FORMING PROCESS USING THE SAME

[75] Inventors: Shuji Sato; Chiaki Suzuki; Tetsu Torigoe; Satoshi Inoue; Takahisa Fujii, all of Minami-Ashigara, Japan

[73] Assignee: Fuji Xerox Co., Ltd., Tokyo, Japan

[21] Appl. No.: 518,995

[22] Filed: Aug. 24, 1995

[30] Foreign Application Priority Data

Sep. 12, 1994 [JP] Japan ..... 6-242420

[51] Int. Cl.[6] ..... G03G 9/08; G03G 13/16

[52] U.S. Cl. ..... 430/110; 430/125

[58] Field of Search ..... 430/110, 125

[56] References Cited

U.S. PATENT DOCUMENTS

| | | | |
|---|---|---|---|
| 4,626,487 | 12/1986 | Mitsuhashi et al. | 430/110 |
| 4,931,841 | 6/1990 | Yoshihara | 430/58 |
| 5,120,627 | 6/1992 | Nozomi et al. | 430/59 |
| 5,406,357 | 4/1995 | Nakahara et al. | 430/110 |
| 5,482,806 | 1/1996 | Suzuki et al. | 430/110 |

FOREIGN PATENT DOCUMENTS

| | | |
|---|---|---|
| 53-81127 | 7/1978 | Japan . |
| 61-231564 | 10/1986 | Japan . |
| 61-236560 | 10/1986 | Japan . |
| 1-204068 | 8/1989 | Japan . |

OTHER PUBLICATIONS

Schaffert, R. M. Electrophotography. New York: John Wiley and Sons. pp. 30–32 & 52–54. 1975.

Borsenberger, Paul M and David S. Weiss. New York: Marcel–Dekker, Inc. pp. 6–17. 1993.

*Primary Examiner*—Christopher D. Rodee
*Attorney, Agent, or Firm*—Oliff & Berridge

[57] ABSTRACT

A toner composition for electrostatic charge development having high cleaning property and inhibiting wear of a photoreceptor, filming and deletion. The toner composition comprises toner particles and fluorine-containing cerium oxide fine particles added to the toner particles. The fluorine content of the fluorine-containing cerium oxide fine particles is from 0.1 to 10% by weight. The toner composition is used in an image forming process comprising the steps of (a) charging a latent image carrier, (b) forming an electrostatic latent image on the latent image carrier, (c) developing the electrostatic latent images with a developing agent to form a toner image, (d) transferring the resulting toner image to a receiving material, and (e) removing a toner remaining on the latent image carrier.

13 Claims, No Drawings

TONER COMPOSITION FOR ELECTROSTATIC CHARGE DEVELOPMENT AND IMAGE FORMING PROCESS USING THE SAME

FIELD OF THE INVENTION

The present invention relates to a toner composition for electrostatic charge development and an image forming process using the toner composition. More particularly, the present invention relates to a toner composition for electrostatic charge development suitable for an image forming device having a stage for transferring a toner to a developing unit with a toner transfer member and a stage for cleaning a latent image carrier, and an image forming process using the toner composition.

BACKGROUND OF THE INVENTION

At present, known dry developing processes in various electrostatic copying systems include a two-component developing system using a toner and a carrier such as an iron powder, and a one-component magnetic developing system using a toner containing a magnetic substance in the inside thereof without using the carrier, which are used in copying machines, printers, etc.

The developing system using the one-component magnetic toner does not require an automatic concentration controller necessary to a developing machine of the two-component developing system, so that maintenance such as carrier exchange is not required. This system has therefore come into use not only in low-speed small-sized copying machines and printers, but also in medium-speed or higher-speed copying machines, printers and plotters, so that a further improvement in performance has been expected.

The recent progress in digitization not only in the field of printers but also in the field of copying machines makes it possible to form finer latent images, and delicate gradation in small Chinese characters or dots has come to be able to be expressed. It has been therefore desired to faithfully develop highly fine latent images as it is, and studies have been conducted thereon. As a part thereof, the particle size of toners is minimized. Previously, toners having a volume average particle size within the range of from 9 to 11 μm have been used. Recently, however, toners having a volume average particle size of from 4 to 9 μm are becoming the main current.

Although the minimization of the particle size of toners provides the excellent effect, it generally has the drawback of being poor in transfer performance. That is, the minimization of the particle size of toners to 4 μm to 9 μm gives very high image quality, but deteriorates transfer and cleaning abilities. When fine particles having high hardness such as metal and non-metal oxides are added to the surfaces of the toner particles as employed in conventional methods for improving cleaning ability, photoreceptors are unevenly shaved not only to raise problems with regard to maintaining property and resource saving, but also to be affected by changes in potential due to shaving, thereby deteriorating high image quality such as excellent gradation. Further, wax-containing toners reduce the wear of photoreceptors and improves fixing property by suppressing smudges, in which toners are transferred to white paper by fracture after fixing, hot offset, and the like, but deteriorates filming. This makes more difficult to carry out a cleaning process of toners remaining on the surfaces of the photoreceptors after transfer.

Further, when a charging roller or a transfer roller to which a high voltage has been applied is used in a charging stage or a transfer stage, a residue on the surface of a photoreceptor is brought into contact with the charging roller or the transfer roller under pressure. As a result, a toner, toner components, a fluidity imparting agent added to the toner, etc. remaining on the photoreceptor are transferred to the charging roller or the transfer roller to contaminate the surface thereof. Consequently, essential functions such as the charging function and the transfer function are prevented, thus resulting in a decrease in image density in long-term use and in generation of image unevenness.

Furthermore, when the one-component magnetic toner is used in a developing stage, it is considered to be more easily cleaned than a nonmagnetic toner because of the action of a relatively free magnetic substance. However, for example, when a cleaning blade such as a rubber blade frequently employed is used, there cause problems, for example, the toner components remaining on the surface of the photoreceptor are scraped, thereby damaging the surface of the photoreceptor and causing adhesion of the toner components. In particular, when wax is added to improve smudges, in which toners are transferred to white paper by fracture of parts of fixed images scrubbed and the hot offset phenomenon, adhesion of the toner easily takes place. Further, wear of the cleaning blade itself also occurs to bring about a reduction in cleaning performance, which causes black streaks, image distortion, tailing, etc. in images. They are unfavorable for providing high image quality.

In order to improve the above problems, attempts have previously been made to add fine inorganic particles such as metal/non-metal oxide particles to the surfaces of the toner particles. For example, JP-A-53-81127 (the term "JP-A" as used herein means an "unexamined published Japanese patent application) discloses the technique of adding an abrasive such as $CeO_2$ to a toner and scraping an adhered material on a photoreceptor. JP-A-61-236560 also discloses the technique of adding $CeO_2$ as an essential component and further adding a rare earth element compound for the same purpose. In these cases, however, when the photoreceptor has an organic photoconductive layer, the abrasive having a higher hardness than the surface of the photoreceptor gets into between the blade and the surface of the photoreceptor to thereby shave the surface layer. Problems are therefore encountered with regard to maintaining property and life, although adhesion of the toner components is inhibited. Further, the surface layer is unevenly shaved by variously sized $CeO_2$, so that deterioration of image quality by changes in potential takes place. As the technique for suppressing these troubles, JP-A-61-231564 discloses addition of abrasives having low hardness such as carbonates and sulfates of alkaline earth metals, rare earth elements and transition metals, tri-iron tetroxide and clay minerals having a layer structure. However, there is a fear of poor cleaning due to low hardness and a reduction in gradation reproduction due to electrostatic charge leak caused by water inclusion property of clay minerals themselves. Further, although a photoreceptor mainly formed of amorphous silicon can prevent image flowing, the charging level under the circumstances of low temperature and humidity is high, and the charge-up phenomenon is largely observed. Problems arise with regard to image density maintaining property and ghosts in the one-component developing system. On the other hand, JP-A-1-204068 discloses addition of cerium fluoride giving attention to its low surface energy. However, fluorine content of cerium fluoride is too high, so that it has the problem of poor cleaning. Further, since the negative charging property becomes too high, a problem is encountered with regard to image density maintaining property.

As described above, the conventional techniques have various problems, which have not been solved yet at present.

SUMMARY OF THE INVENTION

It is therefore an object of the present invention to provide a toner composition having high cleaning property which restrains wear of a photoreceptor, filming and deletion that a talc component and the like contained in paper adhere to the photoreceptor to cause image coming off/flowing, and an image forming process using the toner composition.

Another object of the present invention is to provide a toner composition excellent in gradation which faithfully reproduces digital latent images, and an image forming process using the toner composition.

Still another object of the present invention is to provide a toner composition which can provides an image having high resolution.

A further object of the present invention is to provide a toner composition excellent in dot reproducibility and thin line reproducibility, and an image forming process using the toner composition.

A still further object of the present invention is to provide a toner composition practically sufficiently wide in fog latitude at a high image density, and an image forming process using the toner composition.

A still more further object of the present invention is to provide an image forming process in which a charging roller and a transfer roller are prevented from being contaminated, and which stably provides excellent images for a long period of time.

As a result of studies, the present inventors have discovered that the above-mentioned objects can be attained by adding fluorine-containing cerium oxide fine particles to toner particles, thus completing the present invention.

The present invention relates to a toner composition for electrostatic charge development, which comprises (i) toner particles and (ii) fluorine-containing cerium oxide fine particles added to said toner particles.

Further, the present invention relates to an image forming process comprising:

(a) charging a latent image carrier having a photoconductive layer;

(b) forming an electrostatic latent image on the latent image carrier;

(c) developing the electrostatic latent image with a developing agent comprising a toner composition for electrostatic charge development, which comprises (1) toner particles and (2) fluorine-containing cerium oxide fine particles added to the toner particles, to form a toner image;

(d) transferring the toner image to a receiving material; and (e) removing a toner remaining on the latent image carrier.

Another embodiment of the image forming process of the present invention comprises:

(a) charging a latent image carrier with using a charging roller to which voltage has been applied;

(b) forming an electrostatic latent image on the latent image carrier;

(c) developing the electrostatic latent image with a developing agent comprising a toner composition for electrostatic charge development, which comprises (1) toner particles and (2) fluorine-containing cerium oxide fine particles added to said toner particles, to form a toner image;

(d) transferring the toner image to a receiving material with using a transfer roller to which voltage has been applied; and (e) removing a toner remaining on the latent image carrier.

Still another embodiment of the image forming process of the present invention comprises:

(a) charging a latent image carrier having an organic photoconductive layer;

(b) forming an electrostatic latent image on the latent image carrier;

(c) developing the electrostatic latent images with a developing agent comprising a toner composition for electrostatic charge development, which comprises (1) toner particles and (2) fluorine-containing cerium oxide fine particles added to said toner particles, to form a toner image;

(d) transferring the toner image to a receiving material; and (e) removing a toner remaining on the latent image carrier with using a cleaning blade, wherein said process has a speed of from 90 to 300 mm/second.

DETAILED DESCRIPTION OF THE INVENTION

The toner composition of the present invention may be a one-component magnetic developing agent, a one-component nonmagnetic developing agent or a two-component developing agent.

The toner particles contained in the toner composition of the present invention preferably have a 50% volume average particle size of from 4 to 9 μm. The particle size was measured with a particle size analyzer (TA-II, manufactured by Coulter counter) at an aperture diameter of 100 μm.

A binder resin for use in the toner particles include known synthetic resins and natural resins which have previously been used.

For example, homopolymers or copolymers made of one or more kinds of vinyl monomers can be used. Typical examples of the vinyl monomers for use in the present invention include styrene, p-chlorostyrene, vinylnaphthalene, ethylenically unsaturated monoolefins such as ethylene, propylene, butylene and isobutylene; vinyl esters such as vinyl chloride, vinyl bromide, vinyl fluoride, vinyl acetate, vinyl propionate, vinyl benzoate, vinyl formate, vinyl stearate and vinyl caproate; ethylenic monocarboxylic acids and esters thereof such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; substituted compounds of ethylenic monocarboxylic acids such as acrylonitrile, methacrylonitrile and acrylamide; ethylenic carboxylic acids and esters thereof such as dimethyl maleate, diethyl maleate and dibutyl maleate; vinylketones such as vinyl methyl ketone, vinyl hexyl ketone and methyl isopropenyl ketone; vinyl ethers such as vinyl methyl ether, vinyl isobutyl ether and vinyl ethyl ether; vinylidene halides such as vinylidene chloride and vinylidene chlorofluoride; and N-vinyl compounds such as N-vinylpyrrole, N-vinylcarbazole, N-vinylindole and N-vinylpyrrolidone. Styrene resins and Polyester resins are preferably used as the binder resin.

When the toner composition has magnetic toner particles, the toner particles contain a finely divided magnetic powder. Known magnetic substances can be used for the finely divided magnetic powder in the present invention. Examples of the magnetic substances include metals such as iron, cobalt and nickel and alloys thereof; metal oxides such as $Fe_3O_4$, $\gamma$-$Fe_2O_3$ and cobalt-containing iron oxide; and various kinds of ferrite such as MnZn ferrite and NiZn ferrite. Of these, $Fe_3O_4$ and ferrites are preferred. The magnetic toner particles preferably contain the finely divided magnetic powder in an amount of from 30 to 70% by weight based on the weight of the magnetic toner particles.

In the present invention, the toner particles of the toner composition may contain various substances for charge control, electric resistance control, coloring, etc. as needed. Examples of such substances include fluorine containing surface active agents, salicylic acid, chrome dyes such as chromium complexes, polymer acids such as copolymers containing maleic acid as a monomer component, quaternary ammonium salts, azine dyes such as nigrosine and carbon black.

Further, the toner particles may contain a mold releasing agent such as a wax. As such a wax, a paraffin having 8 or more carbon atoms or a polyolefin is preferably used. Examples thereof include paraffin waxes, paraffin latexes, microcrystalline waxes, low molecular weight polyethylene and low molecular weight polypropylene. The toner particles may contain the mold releasing agent in an amount of generally from 1 to 10% by weight, preferably from 2 to 8% by weight, based on the weight of the toner particles.

The toner composition of the present invention comprises the toner particles comprising the above-mentioned components, and fluorine-containing cerium oxide fine particles.

The fluorine-containing cerium oxide for use in the present invention can be obtained, for example, from fluorine-containing raw ore (bastnaesite). In this case, fluorine is contained in cerium oxide in the form of R—O—F (wherein R represents a rare earth element, O represents an oxygen atom, and F represents a fluorine atom). Further, the fluorine-containing cerium oxide can also be prepared by treating R—O—F-free cerium oxide obtained from fluorine-free raw ore (monazite) with a fluorine-containing surface treating agent. The fluorine-containing surface treating agents for use in this case include fluoroalkylsilanes such as trifluoropropyltrimethoxysilane, trifluoropropyltrichlorosilane, tridecafluorodecyltrichlorosilane, tridecafluorooctyltrimethoxysilane, heptadecafluorodecyltrichlorosilane, heptadecafluorodecyltrimethoxysilane, heptadecafluorodecylmethyldimethoxysilane and heptadecafluorodecylmethyldichlorosilane, and fluorine-modified silicone oil.

The fluorine content of the fluorine-containing cerium oxide fine particles is preferably from 0.1 to 10.0% by weight, more preferably from 0.3 to 3.0% by weight. Further, the fluorine-containing cerium oxide fine particles for use in the present invention preferably have a volume average particle size of from 0.03 to 6 μm, and more preferably from 0.1 to 2.0 μm. The particle size of the fluorine-containing cerium oxide fine particles was measured with a Microtrac particle size analyzer (manufactured by Leeds & Northrup).

Furthermore, the above-described fluorine-containing cerium oxide fine particles are preferably added in an amount of from 0.3 to 10 parts by weight, more preferably 0.3 to 5.0 parts by weight per 100 parts by weight of toner particles.

In the toner composition of the present invention, fine particles of an inorganic material such as silica or titania may also be added to the toner particles, as needed, for the purpose of improving fluidity or charging property. The fine inorganic particles preferably have a primary particle size of 5 nm to 50 nm, and fine inorganic particles which have been subjected to surface treatment such as treatment for making them hydrophobic can also be used. The fine inorganic particles are preferably added in an amount of from 0.1 to 5 parts by weight per 100 parts by weight of the toner particles.

Although the toner composition of the present invention can be produced by known methods, it is particularly preferred to produce the toner particles by grinding systems. That is, a binder resin, a magnetic substance, a colorant, etc. are melt kneaded with the use of a heated kneader. The mixture is then cooled and ground, followed by classification to obtain toner particles. Finely divided fluorine-containing cerium oxide is added to the resulting toner particles, to which silica or titania is further added as needed, and mixed by means of a Henschel mixer to obtain a toner composition.

Although the above-described toner composition of the present invention can be used as a one-component developing agent, it can also be used as a two-component developing agent. Carriers for use in the two-component developing agent include powdered iron, various ferrite powders, various magnetite powders, various metal powders and glass beads. Resin coating layers may be formed on the surfaces of the carriers for the purpose of such as charge control as needed. Further, a so-called dispersion type carrier, that is, particles obtained by melt kneading a binder resin and a magnetic powder, and grinding the resulting mixture, followed by classification, or particles obtained by melt kneading a binder resin and a magnetic powder, and subjecting the resulting mixture to spray cooling, followed by granulation can also be suitably used. As the binder resins and the magnetic powders for use in this case include all of those exemplified with respect to the above-described toner particles.

Then, the image forming process using the above-described toner composition is described. The image forming process of the present invention comprises the steps of:

(a) charging a latent image carrier having a photoconductive layer;

(b) forming an electrostatic latent image on the latent image carrier;

(c) developing the electrostatic latent image with a developing agent comprising a toner composition for electrostatic charge development, which comprises toner particles and fluorine-containing cerium oxide fine particles added to the toner particles, to form a toner image;

(d) transferring the toner image to a receiving material; and (e) removing a toner remaining on the latent image carrier.

The latent image carrier for use in the image forming process of the present invention include not only electrophotographic photoreceptors comprising an electrically-conductive support having thereon a photoconductive layer, but also electrostatic recording materials comprising an electrically-conductive support having thereon a dielectric layer. As the photoconductive layer of the electrophotographic photoreceptor, a deposition layer mainly comprising amorphous silicon, an organic photoconductive layer comprising a binder resin and an organic photoconductive substance contained in the binder resin, and the like can be used. Further, the latent image carrier for use in the present invention preferably has a diameter ranging from 5 to 40 mm.

Examples of the step of charging the latent image carrier include the method of uniformly charging by corona discharge and the method of charging with using a charging roller to which voltage has been applied. Further, the step of forming an electrostatic latent image on the latent image carrier may be any known process in the art. The electrostatic latent image formed are then developed with the use of the above-described toner composition, and the resulting toner image is transferred to a receiving material. In transferring the toner image to a receiving material, the method using a transfer corotron is generally employed, but the transfer roller to which voltage has been applied may also be used. Examples of the step of removing a toner remaining on the latent image carrier include a blade cleaning method, a brush cleaning method, a roll cleaning method, etc. A cleaning method using only a cleaning blade is preferably employed in the present invention.

The above-described toner composition of the present invention is particularly effective when applied to a image forming process comprising the steps of:

(a) charging a latent image carrier with using a charging roller to which voltage has been applied;

(b) forming an electrostatic latent image on the latent image carrier;

(c) developing the electrostatic latent image with a developing agent to form a toner image;

(d) transferring the toner image to a receiving material with using a transfer roller to which voltage has been applied; and (e) removing a toner remaining on the latent image carrier, or to a image forming process comprising the steps of:

(a) charging a latent image carrier having an organic photoconductive layer;

(b) forming an electrostatic latent image on the latent image carrier;

(c) developing the electrostatic latent image with a developing agent to form a toner image;

(d) transferring the toner image to a receiving material; and (e) removing a toner remaining on the latent image carrier with using a cleaning blade, wherein said process has a speed of from 90 to 300 mm/second.

The present invention will be described in detail with reference to the Examples given below, but these Examples are not to be construed as limiting the invention. All percentages and parts are by weight, unless otherwise indicated.

EXAMPLE 1

| | |
|---|---|
| Binder Resin: | |
| Styrene-n-Butyl Acrylate Copolymer (Mw = 150,000, copolymerization ratio = 80:20) | 45% |
| Magnetic Substance: | |
| Magnetite (population average particle size: 0.23 μm) | 50% |
| Charge Controlling Agent: | |
| TRH (Cr-containing dye, manufactured by Hodogaya Chemical Co., Ltd.) | 1% |
| Mold Releasing Agent: | |
| Polypropylene Wax (660P, manufactured by Sanyo Chemical Industries, Ltd.) | 4% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.5 μm. The product was further classified to obtain toner particles having a 50% volume average particle size of 7.0 μm.

Then, 1.0 part of hydrophobic silica and 0.5 parts of fluorine-containing cerium oxide fine particles (fluorine content: 1.0% by weight; volume average particle size: 0.85 μm) were added to 100 parts of the toner particles, and mixed by means of a Henschel mixer to obtain a toner composition.

EXAMPLE 2

| | |
|---|---|
| Binder Resin: | |
| Polyester (Bisphenol A Polyester) (Mw = 50,000) | 45% |
| Magnetic Substance: | |
| Magnetite (population average particle size: 0.23 μm) | 50% |
| Charge Controlling Agent: | |
| TRH (Cr-containing dye, manufactured by Hodogaya Chemical Co., Ltd.) | 1% |
| Mold Releasing Agent: | |
| Polypropylene Wax (660P, manufactured by Sanyo Chemical Industries, Ltd.) | 4% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.5 μm. The product was further classified to obtain toner particles having a 50% volume average particle size of 7.0 μm.

Then, 1.0 part of hydrophobic silica and 0.5 parts of fluorine-containing cerium oxide fine particles (fluorine content: 1.0% by weight; volume average particle size: 0.75 μm) were added to 100 parts of the toner particles, and mixed by means of a Henschel mixer to obtain a toner composition.

EXAMPLE 3

| | |
|---|---|
| Binder Resin: | |
| Styrene-n-Butyl Acrylate Copolymer (Mw = 150,000, copolymerization ratio = 80:20) | 45% |

-continued

| | |
|---|---|
| Magnetic Substance: | |
| Magnetite (population average particle size: 0.23 μm) | 50% |
| Charge Controlling Agent: | |
| TRH (Cr-containing dye, manufactured by Hodogaya Chemical Co., Ltd.) | 1% |
| Mold Releasing Agent: | |
| Polypropylene Wax (660P, manufactured by Sanyo Chemical Industries, Ltd.) | 4% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.5 μm. The product was further classified to obtain toner particles having a 50% volume average particle size of 7.0 μm.

Then, 1.0 part of hydrophobic silica and 0.5 parts of fluorine-containing cerium oxide fine particles (fluorine content: 0.5% by weight; volume average particle size: 0.80 μm) were added to 100 parts of the toner particles, and mixed by means of a Henschel mixer to obtain a toner composition.

EXAMPLE 4

| | |
|---|---|
| Binder Resin: | |
| Styrene-n-Butyl Acrylate Copolymer (Mw = 150,000, copolymerization ratio = 80:20) | 87.25% |
| Carbon Black: | |
| (R330, manufactured by CABOT Co., Ltd.) | 6% |
| Charge Controlling Agent: | |
| P-51 (manufactured by Orient Chemical Industries Co., Ltd.) | 0.75% |
| Mold Releasing Agent: | |
| Polypropylene Wax (660P, manufactured by Sanyo Chemical Industries, Ltd.) | 6% |

The above-described materials were mixed in the powder state by means of a Henschel mixer, and the mixture was heated and melt kneaded with a Bumbury mixer. After cooling, the resulting mixture was roughly ground, and then finely ground to obtain a ground product having a 50% volume average particle size of 8.2 μm. The product was further classified to obtain toner particles having a 50% volume average particle size of 8.5 μm.

Then, 1.0 part of hydrophobic titania and 0.5 parts of fluorine-containing cerium oxide fine particles (fluorine content: 0.5% by weight; volume average particle size: 0.70 μm) were added to 100 parts of the toner particles, and mixed by means of a Henschel mixer to obtain a toner composition.

Comparative Example 1

| | |
|---|---|
| Binder Resin: | |
| Styrene-n-Butyl Acrylate Copolymer (Mw = 150,000, copolymerization ratio = 80:20) | 45% |
| Magnetic Substance: | |
| Magnetite (population average particle size: 0.23 μm) | 50% |
| Charge Controlling Agent: | |
| TRH (Cr-containing dye, manufactured by Hodogaya Chemical Co., Ltd.) | 1% |
| Mold Releasing Agent: | |
| Polypropylene Wax (660P, manufactured by Sanyo Chemical Industries, Ltd.) | 4% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.5 μm. The product was further classified to obtain toner particles having a 50% volume average particle size of 7.0 μm.

Then, 1.0 part of hydrophobic silica and 0.5 parts of fine cerium oxide particles (free from fluorine; volume average particle size: 0.80 μm) were added to 100 parts of the toner particles, and mixed by means of a Henschel mixer to obtain a toner composition.

Comparative Example 2

| | |
|---|---|
| Binder Resin: | |
| Styrene-n-Butyl Acrylate Copolymer (Mw = 150,000, copolymerization ratio = 80:20) | 45% |
| Magnetic Substance: | |
| Magnetite (population average particle size: 0.23 μm) | 50% |
| Charge Controlling Agent: | |
| TRH (Cr-containing dye, manufactured by Hodogaya Chemical Co., Ltd.) | 1% |
| Mold Releasing Agent: | |
| Polypropylene Wax (660P, manufactured by Sanyo Chemical Industries, Ltd.) | 4% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.5 μm. The product was further classified to obtain toner particles having a 50% volume average particle size of 7.0 μm.

Then, 1.0 part of hydrophobic silica was added to 100 parts of the toner particles, and mixed by means of a Henschel mixer to obtain a toner composition.

Comparative Example 3

| | |
|---|---|
| Binder Resin: | |
| Styrene-n-Butyl Acrylate Copolymer (Mw = 150,000, copolymerization ratio = 80:20) | 87.25% |
| Carbon Black: | |
| (R330, manufactured by CABOT Co., Ltd.) | 6% |
| Charge Controlling Agent: | |
| P-51 (manufactured by Orient Chemical Industries Co., Ltd.) | 0.75% |
| Mold Releasing Agent: | |
| Polypropylene Wax (660P, manufactured by Sanyo Chemical Industries, Ltd.) | 6% |

The above-described materials were mixed in the powder state by means of a Henschel mixer, and the mixture was heated and melt kneaded with a Bumbury mixer. After cooling, the resulting mixture was roughly ground, and then finely ground to obtain a ground product having a 50% volume average particle size of 8.2 μm. The product was further classified to obtain toner particles having a 50% volume average particle size of 8.5 μm.

Then, 1.0 part of hydrophobic titania and 0.5 parts fine cerium oxide particles (free from fluorine; volume average particle size: 0.75 μm) were added to 100 parts of the toner particles, and mixed by means of a Henschel mixer to obtain a toner composition.

Of these toner compositions, the one-component magnetic developing agents were evaluated with a modified machine of an XP-15 printer (manufactured by Fuji Xerox Co., Ltd.) which was increased in speed to 30 prints/minute (process speed: 136 mm/second) and converted to 600 dpi. A running test of about 30,000 prints was conducted under the circumstances of high temperature and humidity (30° C., 80% RH), and an adhered substance on a photoreceptor and the wear of the photoreceptor were observed.

Further, the one-component nonmagnetic developing agents were evaluated with a modified machine of a Vivace 200 printer (manufactured by Fuji Xerox Co., Ltd.) which was provided with a toner supply roller for toner transfer and increased in speed to 30 prints/minute (process speed: 140 mm/second). A running test of about 30,000 prints was conducted under the circumstances of high temperature and humidity (30° C., 80% RH), and an adhered substance on a photoreceptor and the wear of the photoreceptor and a blade were observed. The results obtained are shown in Table 1. Here, the term "deletion" means image coming off which is considered to be caused by charge leak generated by adhesion of a talc component and the like contained in paper to the surface of the photoreceptor.

TABLE 1

| | Deletion (*1) | Wear of Photo-receptor (*2) | Wear of Blade (*2) | Adhesion on Photoreceptor | Image |
|---|---|---|---|---|---|
| Example 1 | G0 | ⊚ | o | No problem | No problem |
| Example 2 | G0 | o | o | No problem | No problem |
| Example 3 | G0.5 | o | o | No problem | No problem |
| Example 4 | G0.5 | o | o | No problem | No problem |
| Comparative Example 1 | G2.5 | x | x | Developed on and after 500th print | Image flowing/ black streaks were generated (500th print) |
| Comparative Example 2 | G3.0 | Δ | Δ | Slightly developed on and after 900th print | Slight black streaks were generated (900th print) |
| Comparative Example 3 | G2.5 | x | x | Developed on and after 600th print | Slight black streaks were generated (600th print) |

*1 Deletion Grade
G0: Not generated.
G1: Although generated in zip tones or characters, very slightly.
G2: Generated in zip tones or characters in a narrow strip form.
G3: Generated in zip tones or characters in a wide strip form.
G4: Generated on the whole surface.
G5: Generated on the whole surface (impossible to read characters).
*2 Wear Level
⊚: Very good (no substantial wear)
o: Good (slight wear)
Δ: A level where a problem does not practically occur (Images are not largely distorted)
x: Images are largely distorted.

EXAMPLE 5

| | |
|---|---|
| Binder Resin: | |
| Styrene-n-Butyl Acrylate Copolymer (Mw = 170,000, copolymerization ratio = 80:20) | 49.2% |
| Magnetic Substance: | |
| Magnetite (population average particle size: 0.23 μm) | 50% |

-continued

| | |
|---|---|
| Charge Controlling Agent: | |
| P-51 (manufactured by Orient Chemical Industries Co., Ltd.) | 0.8% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.9 μm. The product was further classified to obtain toner particles having a 50% volume average particle size of 7.3 μm.

Then, 0.5 parts of hydrophobic silica and 0.5 parts of fluorine-containing cerium oxide fine particles (fluorine content: 1.0% by weight; volume average particle size: 0.80 μm) were added to 100 parts of the toner particles, and mixed by means of a Henschel mixer to obtain a toner composition.

EXAMPLE 6

| | |
|---|---|
| Binder Resin: | |
| Polyester (Bisphenol A Polyester) (Mw = 60,000) | 49.2% |
| Magnetic Substance: | |
| Magnetite (population average particle size: 0.23 μm) | 50% |
| Charge Controlling Agent: | |
| P-51 (manufactured by Orient Chemical Industries Co., Ltd.) | 0.8% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.7 μm. The product was further classified to obtain toner particles having a 50% volume average particle size of 7.1 μm.

Then, 0.5 parts of hydrophobic silica and 0.5 parts of fluorine-containing cerium oxide fine particles (fluorine content: 1.0% by weight; volume average particle size: 0.80 μm) were added to 100 parts of the toner particles, and mixed by means of a Henschel mixer to obtain a toner composition.

EXAMPLE 7

A toner composition was obtained in the same manner as in Example 5 except that hydrophobic silica was not added to the toner particles.

Comparative Example 4

A toner composition was obtained in the same manner as in Example 5 except that fluorine-containing cerium oxide fine particles was changed with the same parts of fine cerium oxide particles (free from fluorine; volume average particle size: 0.75 μm).

Comparative Example 5

A toner composition was obtained in the same manner as in Example 5 except that fluorine-containing cerium oxide fine particles was not added to the toner particles.

Comparative Example 6

The same toner particles as in Example 5 was obtained and no additive was added thereto. The toner particles was used as a toner.

These toner compositions were evaluated with a modified machine of an XP-15 printer (manufactured by Fuji Xerox Co., Ltd.) which was increased in speed to 30 prints/minute (process speed: 136 mm/second) and equipped with an a-Si photoreceptor. A running test of about 30,000 prints was conducted under the circumstances of low temperature and humidity (10° C., 15% RH), and the image density and the charge maintaining property were observed. Further, a running test was also conducted under the circumstances of high temperature and humidity (30° C., 80% RH), and the cleaning performance was evaluated. The a-Si photoreceptor was prepared on a substrate by decomposing a silane gas by glow discharge in an pressure-reduced container (plasma CVD method). The results obtained are shown in Table 2.

TABLE 2

| | Initial Charge Amount (*1) (μc/g) | Charge Amount After 30,000 Prints (*1) (μc/g) | Initial Image Density (*2) | Image Density After 30,000 Prints (*2) | Image/Toner State | Cleaning Property (*3) |
|---|---|---|---|---|---|---|
| Example 5 | 12.5 | 13.1 | 1.46 | 1.45 | No problem | o |
| Example 6 | 13.5 | 15.4 | 1.45 | 1.43 | No problem | o |
| Example 7 | 10.5 | 12.5 | 1.40 | 1.41 | No problem | o |
| Comparative Example 4 | 12.4 | 21.5 | 1.45 | 0.78 | Density unevenness was observed | o |
| Comparative Example 5 | 13.9 | 23.3 | 1.42 | 0.85 | Density unevenness was observed | Δ |
| Comparative Example 6 | 7.5 | 6.5 | 1.25 | 0.56 | Poor charging due to toner coagulation | x |

*1 The charge amount was measured with a vacuum type tribometer.
*2 The image density was determined by measuring a patch on a sample with an X-Rite 404A.
*3 Cleaning Property TABLE 2-continued

| Initial Charge Amount (*1) (μc/g) | Charge Amount After 30,000 Prints (*1) (μc/g) | Initial Image Density (*2) | Image Density After 30,000 Prints (*2) | Image/Toner State | Cleaning Property (*3) |
|---|---|---|---|---|---|

o: No toner adhered to the photoreceptor.
Δ: The toner adhered to the photoreceptor after 3,000 to 10,000 prints.
x: The toner adhered to the photoreceptor before 3,000 prints.

EXAMPLE 8

| | |
|---|---|
| Binder Resin: | |
| Styrene-n-Butyl Acrylate Copolymer (Mw = 170,000, copolymerization ratio = 80:20) | 47% |
| Magnetic Substance: | |
| Magnetite (population average particle size: 0.23 μm) | 50% |
| Mold Releasing Agent: | |
| Polypropylene Wax (660P, manufactured by Sanyo Chemical Industries, Ltd.) | 3% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.8 μm. The product was further classified to obtain toner particles having a 50% volume average particle size of 7.2 μm.

Then, 1.0 part of hydrophobic silica and 0.5 parts of fluorine-containing cerium oxide fine particles (fluorine content: 1.0% by weight; volume average particle size: 0.80 μm) were added to 100 parts of the toner particles, and mixed by means of a Henschel mixer to obtain a toner composition.

EXAMPLE 9

| | |
|---|---|
| Binder Resin: | |
| Polyester (Bisphenol A Polyester) (Mw = 50,000) | 47% |
| Magnetic Substance: | |
| Magnetite (population average particle size: 0.23 μm) | 50% |
| Mold Releasing Agent: | |
| Polypropylene Wax (660P, manufactured by Sanyo Chemical Industries, Ltd.) | 3% |

The above-described materials were mixed in the powder state by means of a Henschel mixer, and the mixture was heated and melt kneaded with an extruder set to have a temperature of 150° C. After cooling, the resulting mixture was roughly ground, and then finely ground to obtain a ground product having a 50% volume average particle size of 6.6 μm. The product was further classified to obtain toner particles having a 50% volume average particle size of 7.1 μm.

Then, 1.0 part of hydrophobic silica and 0.5 parts of fluorine-containing cerium oxide fine particles (fluorine content: 1.0% by weight; volume average particle size: 0.75 μm) were added to 100 parts of the toner particles, and mixed by means of a Henschel mixer to obtain a toner composition.

EXAMPLE 10

A toner composition was obtained in the same manner as in Example 8 except that hydrophobic silica was not added to the toner particles.

Comparative Example 7

A toner composition was obtained in the same manner as in Example 8 except that fluorine-containing cerium oxide fine particles was changed with the same parts of fine cerium oxide particles (free from fluorine; volume average particle size: 0.70 μm).

Comparative Example 8

A toner composition was obtained in the same manner as in Example 8 except that fluorine-containing cerium oxide fine particles was not added to the toner particles.

Comparative Example 9

The same toner particles as in Example 8 was obtained and no additive was added thereto. The toner particles was used as a toner.

These toner compositions were evaluated with a modified machine of an XP-15 printer (manufactured by Fuji Xerox Co., Ltd.) which was increased in speed to 30 prints/minute (process speed: 136 mm/second), converted to 600 dpi, and equipped with a photoreceptor having a diameter of 25 mm. A running test of about 70,000 prints was conducted under the circumstances of high temperature and humidity (30° C., 80% RH), and the image density, the adhesion to the photoreceptor and the wear of the photoreceptor and a blade were observed.

An organic photoreceptor was used as the photoreceptor. The organic photoreceptor has an undercoatlayer and a photoconductive layer formed on a electrically conductive support, the undercoatlayer being formed by curing a composition mainly composed of an organic zirconium compound with a silane coupling agent, and the photoconductive layer comprising (i) a charge generating layer mainly composed of phthalocyanine and containing a vinyl chloride-vinyl acetate copolymer, and (ii) a charge transfer layer having a polycarbonate resin and a diamine charge transfer material dispersed in the polycarbonate resin. Further, a cleaning blade made of a urethane resin was used as a cleaning means.

The results obtained are shown in Table 3.

TABLE 3

| | Deletion (*1) | Wear of Photoreceptor (*2) | Wear of Blade (*2) | Image Density (*3) | Adhesion on Photoreceptor | Image |
|---|---|---|---|---|---|---|
| Example 8 | G0 | ⊙ | ⊙ | 1.46 | No problem | No problem |
| Example 9 | G0 | ⊙ | ⊙ | 1.45 | No problem | No problem |
| Example 10 | G0 | ⊙ | ⊙ | 1.40 | No problem | No problem |
| Comparative Example 7 | G2.5 | x | x | 1.05 | Developed on and after 400th print | Image flowing/ black streaks were generated (400th print) |
| Comparative Example 8 | G3.0 | Δ | x | 1.12 | Slightly developed on and after 600th print | Slight black streaks were generated (600th print) |
| Comparative Example 9 | G4.5 | ⊙ | ⊙ | 0.79 | Developed on and after 150th print | Large image distortion/ reduction in density due to toner blocking/ black streaks were generated (150th print) |

*1 Deletion Grade
G0: Not generated.
G1: Although generated in zip tones or characters, very slightly.
G2: Generated in zip tones or characters in a narrow strip form.
G3: Generated in zip tones or characters in a wide strip form.
G4: Generated on the whole surface.
G5: Generated on the whole surface (impossible to read characters).
*2 Wear Level
⊙: Very good (no substantial wear)
o: Good (slight wear)
Δ: A level where a problem does not practically occur (Images are not largely distorted)
x: Images are largely distorted.
*3 Image Density
The image density was determined by measuring a patch on a sample with an X-Rite 404A.

In the following Examples and Comparative Examples, fine cerium oxide particles containing or free from fluorine, prepared by the following Preparation Example, were used.

(Preparation Example of Fine Cerium Oxide Particles)

Bastnaesite was ground, subjected to wet treatment and filtered, followed by roasting, grinding and classification to obtain fluorine-containing cerium oxide fine particles A having a volume average particle size of 0.6 μm. The fluorine content was 6.0% by weight in terms of fluorine atom conversion.

Monazite was ground, subjected to wet treatment and filtered, followed by roasting, grinding and classification to obtain fine cerium oxide particles C (free from fluorine) having a volume average particle size of 0.6 μm. Then, 20 parts by weight of trifluoropropyltrimethoxysilane was dissolved in 200 parts by weight of methanol, and 100 parts by weight of the above-described fine cerium oxide particles C was added to the 220 parts by weight of solution. After stirring for 1 hour, the mixture was dried at 80° C. under reduced pressure to obtain fluorine-containing cerium oxide fine particles B having a volume average particle size of 0.6 μm. The fluorine content was 8.0% by weight in terms of fluorine atom conversion.

EXAMPLE 11

| | |
|---|---|
| Binder Resin: | |
| Styrene-n-Butyl Acrylate Copolymer (Mw = 180,000, copolymerization ratio = 70:30) | 46% |

-continued

| | |
|---|---|
| Magnetic Substance: | |
| Magnetite (population average particle size: 0.23 μm) | 50% |
| Charge Controlling Agent: | 1% |
| Azo Fe Dye | |
| Mold Releasing Agent: | |
| Polypropylene Wax (660P manufactured by Sanyo Chemical Industries, Ltd.) | 3% |

The above-described materials were mixed in the powder state by means of a Henschel mixer, and the mixture was heated and melt kneaded with an extruder set to have a temperature of 150° C. After cooling, the resulting mixture was ground and classified to obtain toner particles having a 50% volume average particle size of 6 μm.

Then, 1.0 part of the above-described fluorine-containing cerium oxide fine particles A was added as an abrasive to 100 parts of the toner particles, and mixed by means of a Henschel mixer to obtain a one-component magnetic developing agent.

The developing agent was evaluated with a modified machine of an XP-15 printer (manufactured by Fuji Xerox Co., Ltd.). In the modified printer used for evaluation, the corotron charging and transfer devices were converted to a 12 mm diameter charging roller made of an acrylic resin and a 16 mm diameter transfer roller made of an urethane resin.

EXAMPLE 12

A one-component magnetic developing agent was obtained in the same manner as in Example 11, except that the addition amount of fluorine-containing cerium oxide fine particles A was changed to 0.3 part.

The developing agent was evaluated in the same manner as in Example 11.

EXAMPLE 13

| | |
|---|---|
| Binder Resin: | |
| Styrene-n-Butyl Acrylate Copolymer (Mw = 180,000, copolymerization ratio = 75:25) | 85% |
| Colorant: | |
| Carbon Black | 10% |
| Charge Controlling Agent: | |
| Azo Fe Dye | 2% |
| Mold Releasing Agent: | |
| Polypropylene Wax (660P, manufactured by Sanyo Chemical Industries, Ltd.) | 3% |

The above-described materials were mixed in the powder state by means of a Henschel mixer, and the mixture was heated and melt kneaded with an extruder set to have a temperature of 150° C. After cooling, the resulting mixture was ground and classified to obtain toner particles having a volume average particle size of 6 μm.

Then, 10 parts of the above-described fluorine-containing cerium oxide fine particles B was added as an abrasive to 100 parts of the toner particles, and mixed by means of a Henschel mixer to obtain a toner composition.

Then, 10 parts of the toner composition and 90 parts of iron powder having a particle size of 80 μm were mixed by using a V blender to obtain a two-component developing agent.

The developing agent was evaluated with a modified machine of an Able 1301α copying machine (manufactured by Fuji Xerox Co., Ltd.). In the modified copying machine used for evaluation, the corotron charging and transfer devices were converted to a 20 mm diameter charging roller made of an acrylic resin and a 26 mm diameter transfer roller made of an urethane resin, and the cleaning system was converted from the system using both of a blade and a fur brush to a system using only a blade.

EXAMPLE 14

A one-component magnetic developing agent was obtained in the same manner as in Example 11, except that the addition amount of fluorine-containing cerium oxide fine particles A was changed to 0.15 part.

The developing agent was evaluated in the same manner as in Example 11.

EXAMPLE 15

A one-component magnetic developing agent was obtained in the same manner as in Example 13, except that the addition amount of fluorine-containing cerium oxide fine particles B was changed to 15 parts.

The developing agent was evaluated in the same manner as in Example 13.

Comparative Example 10

A one-component magnetic developing agent was obtained in the same manner as in Example 11, except that 1.0 parts of fluorine-containing cerium oxide fine particles A was changed with 10 parts of fine cerium oxide particles C (free from fluorine).

The developing agent was evaluated in the same manner as in Example 11.

Comparative Example 11

A one-component magnetic developing agent was obtained in the same manner as in Example 11, except that 1.0 parts of fluorine-containing cerium oxide fine particles A was changed with 15 parts of fine cerium oxide particles C (free from fluorine).

The developing agent was evaluated in the same manner as in Example 11.

Comparative Example 12

A one-component magnetic developing agent was obtained in the same manner as in Example 11, except that 1.0 parts of fluorine-containing cerium oxide fine particles A was changed with 20 parts of fine cerium oxide particles C (free from fluorine).

The developing agent was evaluated in the same manner as in Example 11.

The results obtained are shown in Table 4.

TABLE 4

| | Fine Cerium Oxide Particles | | Initial | | After 20,000 Copies | | | | |
|---|---|---|---|---|---|---|---|---|---|
| | Kind | Amount Added (parts by weight) | Solid Density | Full Black Uneven Density | Solid Density | Full Black Solid Density | Contamination of Charging Roller | Contamination of Transfer Roller | Wear of Photoreceptor |
| Example 11 | A | 1 | 1.52 | o | 1.53 | o | o | o | o |
| Example 12 | A | 0.3 | 1.52 | o | 1.52 | o | o | o | o |
| Example 13 | B | 10 | 1.50 | o | 1.49 | o | o | o | o |
| Example 14 | A | 0.15 | 1.52 | o | 1.38 | Δ | Δ | Δ | Δ |
| Example 15 | B | 15 | 1.45 | o | 1.40 | o | o | o | x |
| Comparative Example 10 | C | 10 | 1.50 | o | 1.30 | x | x | x | x |
| Comparative Example 11 | C | 15 | 1.44 | o | 1.33 | Δ | Δ | Δ | x |
| Comparative Example 12 | C | 20 | 1.40 | o | 1.28 | o | o | o | x (*1) |

*1 The background of the photoreceptor was exposed.

In Table 4, o means "very good", A means "practically no problem", and x means "serious problem".

The results of Example Nos. 11 to 13 showed that the charging roller and the transfer roller were not contaminated even after 20,000 copies, there was no problem of the wear of the photoreceptor, and the high image density was kept without density unevenness.

Further, the results of Example Nos. 14 and 15 showed that although these Examples were inferior to Examples 11 to 13, they reached a sufficiently available level and exhibited respective effect.

In Comparative Example 10, the cleaning effect was insufficient, the contamination of the charging roller and the transfer roller took place, and the density decrease and density unevenness were generated.

In Comparative Examples 11 and 12, the wear of the photoreceptor was increased, and the density decrease was generated, though the contamination of the charging roller and the transfer roller was very slight or did not take place. Further, Comparative Example 12 was reduced in toner charging property, and exhibited lowered initial density compared with the others.

As described above, in the toner composition for electrostatic charge development of the present invention, the fluorine-containing cerium oxide fine particles are added to the toner particles. Accordingly, the toner composition of the present invention exhibits the high cleaning property, inhibits the wear of the photoreceptor, therefore inhibits filming, and inhibits the deletion that the talc component and the like contained in paper adhere to the photoreceptor to cause image coming off/flowing. Further, the toner composition for electrostatic charge development of the present invention has high resolution, excellent dot reproducibility and thin line reproducibility, and excellent gradation with faithfully reproducing digital latent images. Furthermore, the toner composition for electrostatic charge development has, in practical, sufficiently wide fog latitude at a high image density. The image forming process of the present invention using the toner composition, therefore, can stably provides an image having a high image density which is excellent in resolution, dot reproducibility and thin line reproducibility, for a long period of time. In particular, when a latent image carrier mainly formed of amorphous silicon is used, image flowing under the circumstances of high temperature and humidity can be prevented, and the high charging level, the charge-up phenomenon, etc. under the circumstances of low temperature and humidity are improved.

In addition, when images are formed at high speed using an organic photoreceptor having small diameter as a latent image carrier and a cleaning blade with the use of the toner composition for electrostatic charge development of the present invention prevents the wear of the surface of a latent image carrier and a cleaning blade, restrains toner filming on the photoreceptor, and makes it possible to form a high quality image without density decrease for a long period of time. Further, the image forming process using the charging roller and the transfer roller with the use of the toner composition for electrostatic charge development of the present invention prevents the contamination of the charging roller and the transfer roller, and therefore, can stably provide an excellent image for a long period of time.

What is claimed is:

1. A toner composition for electrostatic charge development, which comprises (i) toner particles and (ii) fluorine-containing cerium oxide fine particles having a fluorine content of from 0.1 to 10.0% by weight added to said toner particles.

2. The toner composition as claimed in claim 1, wherein said toner particles are magnetic toner particles containing a finely divided magnetic powder.

3. The toner composition as claimed in claim 2, wherein said magnetic toner particles contain the finely divided magnetic powder in an amount of from 30 to 70% by weight based on the weight of said magnetic toner particles.

4. The toner composition as claimed in claim 1, wherein said fluorine-containing cerium oxide fine particles have a volume average particle size of from 0.03 to 6 μm.

5. The toner composition as claimed in claim 1, wherein said fluorine-containing cerium oxide fine particles are added to said toner particles in an amount of from 0.3 to 10 parts by weight per 100 parts by weight of said toner particles.

6. The toner composition as claimed in claim 1, wherein said toner particles have a volume average particle size of from 4 to 9 μm.

7. The toner composition as claimed in claim 1, wherein said fluorine-containing cerium oxide fine particles have a fluorine content of from 0.3 to 3.0% by weight.

8. An image forming process comprising:

(a) charging a latent image carrier having a photoconductive layer;

(b) forming an electrostatic latent image on the latent image carrier;

(c) developing the electrostatic latent image with a developing agent comprising a toner composition for electrostatic charge development, which comprises (1) toner particles and (2) fluorine-containing cerium oxide fine particles having a fluorine content of from 0.1 to 10.0% by weight added to said toner particles, to form a toner image;

(d) transferring the toner image to a receiving material; and (e) removing a toner remaining on the latent image carrier.

9. The image forming process as claimed in claim 8, wherein the photoconductive layer of the latent image carrier mainly comprises an amorphous silicon.

10. The image forming process as claimed in claim 9, wherein the latent image carrier has a diameter of 5 mm to 40 mm.

11. The image forming process as claimed in claim 8, wherein the latent image carrier has a diameter of 5 mm to 40 mm.

12. An image forming process comprising:

(a) charging a latent image carrier with a charging roller to which voltage has been applied;

(b) forming an electrostatic latent image on the latent image carrier;

(c) developing the electrostatic latent image with a developing agent comprising a toner composition for electrostatic charge development, which comprises (1) toner particles and (2) fluorine-containing cerium oxide fine particles having a fluorine content of from 0.1 to 10.0% by weight added to said toner particles, to form a toner image;

(d) transferring the toner image to a receiving material with a transfer roller to which voltage has been applied; and (e) removing a toner remaining on the latent image carrier.

13. The image forming process as claimed in claim 12, wherein the latent image carrier has a diameter of 5 mm to 40 mm.

* * * * *